US012471717B2

(12) United States Patent
Liu

(10) Patent No.: US 12,471,717 B2
(45) Date of Patent: Nov. 18, 2025

(54) MATTRESS WITH REPLACEABLE INTERNAL LAYERS AND OUTER COVER

(71) Applicant: CAREMED SUPPLY INC., New Taipei (TW)

(72) Inventor: Tsung-Hsuan Liu, Taipei (TW)

(73) Assignee: CAREMED SUPPLY INC., New Taipei (TW)

( * ) Notice: Subject to any disclaimer, the term of this patent is extended or adjusted under 35 U.S.C. 154(b) by 213 days.

(21) Appl. No.: 18/409,283

(22) Filed: Jan. 10, 2024

(65) Prior Publication Data

US 2025/0221544 A1 Jul. 10, 2025

(51) Int. Cl.
*A47C 27/05* (2006.01)
*A47C 27/06* (2006.01)
*A47C 31/10* (2006.01)

(52) U.S. Cl.
CPC ..... *A47C 27/053* (2013.01); *A47C 27/064* (2013.01); *A47C 31/105* (2013.01)

(58) Field of Classification Search
CPC ... A47C 27/053; A47C 27/045; A47C 27/064; A47C 27/0453; A47C 27/0456; A47C 27/05; A47C 31/105
See application file for complete search history.

(56) References Cited

U.S. PATENT DOCUMENTS 1,211,548 A * 1/1917 Courts ..... A47C 31/026 5/738
1,882,538 A * 10/1932 Wunderlich ..... A47C 27/0453 5/256
2,271,842 A * 2/1942 Nachman ..... A47C 27/053 5/655.7
3,950,800 A * 4/1976 Garshfield ..... A47C 27/04 5/721
4,476,595 A * 10/1984 Ikeda ..... A47C 27/0456 5/267
4,788,731 A * 12/1988 Yokoi ..... A47C 27/056 5/721
5,398,354 A * 3/1995 Balonick ..... A47C 27/20 5/922
11,896,135 B2 * 2/2024 Nguyen ..... A47C 27/003
2016/0353907 A1 * 12/2016 Lava ..... A47C 27/002
2020/0178701 A1 * 6/2020 Lacey ..... A47C 27/14
2021/0120968 A1 * 4/2021 Van Namee ..... A47C 31/105
2021/0235884 A1 * 8/2021 Nolte ..... G06Q 30/0621

* cited by examiner

*Primary Examiner* — Adam C Ortiz
*Assistant Examiner* — Ifeolu A Adeboyejo
(74) *Attorney, Agent, or Firm* — Rabin & Berdo, P.C.

(57) ABSTRACT

A mattress includes an outer cover having a bed frame and an upholstery layer; an elastic support system including a pocket-spring layer, a foam isolation pad layer, a joining fabric layer and a plurality of fixing elements; and a comfort system. The fixing elements are provided on around a perimeter of the elastic support system to clamp the pocket-spring layer, the foam isolation pad layer and the joining fabric layer together. The comfort system includes a plurality of pad layers, an inner cover and a plurality of connecting materials disposed on an undersurface of the inner cover to form a locating pattern for selectively connecting to different locations on the joining fabric layer. Since the upholstery layer, the elastic support system and the comfort system are replaceable; the mattress can provide desirable resilience and support strength to evenly disperse pressure applied by the user to the mattress.

5 Claims, 12 Drawing Sheets

MATTRESS WITH REPLACEABLE INTERNAL LAYERS AND OUTER COVER

FIELD OF THE INVENTION

The present invention relates to a mattress with replaceable internal layers and outer cover, and more particularly, to a mattress having a plurality of internal layers and an outer cover that are selectively replaceable in different combinations.

BACKGROUND OF THE INVENTION

The commonly seen mattress includes a plurality of internal layers and an outer cover. The internal layers are superposed to form a core of the mattress that is suitable for a user to rest thereon. The internal layers are wrapped in the outer cover, which is made of a skin-friendly material suitable for direct contact with the user's skin. These internal layers may include a comfort layer, a spring-supported layer, and a base layer. The comfort layer may be made of synthetic latex or high-density support foam; the spring-supported layer may be made of polymeric foam, isolation foam, stretchable bottom cloth, joining fabric, pocket springs or support springs; and the base layer includes an anti-slip bottom cloth. The outer cover includes an upholstery layer and a bed main body. The upholstery layer may be made of high-class jacquard cloth, Tencel breathable fabric, graphene fabric, cooling and hydrophilic cotton or high-functional cotton; and the bed main body can be extra-thick high-density foam.

Conventionally, the internal layers of the mattress are joined first by sewing two adjacent layers together and then connecting all the sewed up layers sequentially, so that all the internal layers of the mattress are firmly held together without the risk of moving relative to one another easily.

Usually, the mattress is heavy and large in volume, making it uneasy to move or transport. Therefore, people would not change their mattress frequently and a mattress might be used for several decades. Many environmental factors, such as temperature and moisture, would lead to mildewed, molded or oxidized layers or rusted support springs of the mattress. Further, the mattress having been used for a long time tends to become sagging and less even support. The mildewed or molded layers of the mattress will also cause skin allergy.

Further, since the internal layers of the mattress are fixedly connected to the outer cover, both the internal layers and the outer cover are not replaceable freely. In the case any one of the internal layers or the outer cover is worn out or damaged, there is no way but to discard the whole mattress, which is of course unnecessary waste and not environmental friendly.

SUMMARY OF THE INVENTION

A primary object of the present invention is to provide a mattress with replaceable internal layers and outer cover. The internal layers include an elastic support system and a comfort system, which are selectively removable from the outer cover and replaceable with another elastic support system and comfort system, respectively. Further, the outer cover includes a bed frame and an upholstery layer; and the upholstery layer is also removable from the bed frame and replaceable with another upholstery layer having a different material. So that the mattress may have user desirable resilience and support strength and evenly disperse pressure applied to the mattress by the user.

Another object of the present invention is to provide a mattress, an elastic support system of which includes a joining fabric layer, a foam isolation pad layer, and a pocket-spring layer. These three layers are clamped together and held in place by a plurality of fixing elements provided along a perimeter of the elastic support system. Therefore, the pocket-spring layer, the foam isolation pad layer and the joining fabric layer of the elastic support system are joined together with the fixing elements being located at the perimeter of the elastic support system.

A further object of the present invention is to provide a mattress that includes an inner cover and a plurality of connecting materials provided on an undersurface of the inner cover to define a locating pattern. The joining fabric layer of the mattress has an upper surface provided with a locating fabric that is connectable to any position, so that the locating pattern is selectively connectable to any position on the locating fabric and an overlapped area between the comfort system and the elastic support system is changeable in size.

To achieve the above and other objects, the mattress with replaceable internal layers and outer cover according to the present invention includes an outer cover, an elastic support system, and a comfort system. The outer cover includes a bed frame and an upholstery layer. The bed frame is provided with a first male connector and the upholstery layer is provided with a first female connector for removably connecting to the first male connector, such that the upholstery layer is selectively removable and replaceable with another upholstery layer. The bed frame includes a bottom and a sidewall connected to four sides of the bottom, so that a receiving space is defined between the bed frame and the upholstery layer.

In a first preferred embodiment, the elastic support system is removably fitted in the receiving space and includes a pocket-spring layer, a foam isolation pad layer, a joining fabric layer, and a plurality of fixing elements. The foam isolation pad layer is disposed between the pocket-spring layer and the joining fabric layer; an upper surface of the joining fabric layer is provided with a locating fabric; and the fixing elements are spaced on around a perimeter of the elastic support system to bind the pocket-spring layer, the foam isolation pad layer and the joining fabric layer to one another. The locating fabric is distributed over an entire surface of the joining fabric layer to define a first profile.

In the first preferred embodiment, the fixing elements are respectively a C-type retaining ring, which includes a ring body provided with a gap, via which the joining fabric layer and the foam isolation pad layer can be pushed into the C-type retaining ring with two opposite ends of the ring body pressed against the joining fabric layer and an upper boarder rod of the pocket-spring layer, so that the joining fabric layer, the foam isolation pad layer and the pocket-spring layer are together clamped and held in place by the C-type retaining ring.

The comfort system is removably fitted in the receiving space and includes a plurality of pad layers, an inner cover, and a plurality of connecting materials. The pad layers are wrapped in the inner cover. The connecting materials are disposed on an undersurface of the inner cover to define a locating pattern, which is spread over a partial area of the inner cover to define a second profile that has an area smaller than that of the first profile. The locating pattern is selectively connectable to any location on the locating fabric, so that an overlapped area between the comfort system and the elastic support system is changeable in size. The connecting materials include two transverse connecting stripes and two longitudinal connecting stripes, which are spaced from one another to form corner gaps between the inner cover and the locating fabric layer.

The inner cover has an opening provided with a closure zipper that openably closes the opening. The pad layers are fitted into the inner cover via the opening and vertically arranged side by side to form a core of the comfort system before the closure zipper is closed.

The comfort system further includes a plurality of separate dividing covers for wrapping the pad layers in one-to-one correspondence. Each of the separate dividing covers is provided at each of two opposite ends with a second male connector and a second female connector, and any separate dividing cover being connectable to an adjoining one through engagement of the second male connector provided thereon with the second female connector on the adjoining separate dividing cover, such that the separate dividing covers are vertically arranged side by side to form the core of the comfort system.

The elastic support system is selectively removable and replaceable with another elastic support system, and the comfort system is also selectively removable and replaceable with another comfort system, so as to provide a mattress that has user desirable resilience and support strength to disperse pressure applied by the user to the mattress.

In a second preferred embodiment, the elastic support system further includes a bonding layer disposed between the foam isolation pad layer and the joining fabric layer to form an inner connecting zone; and the fixing elements are located around the joining fabric layer and the foam isolation pad layer to form a perimeter connecting zone.

The present invention is characterized in that the bed frame has a first male connector and defines a receiving space, and that the upholstery layer includes a first female connector removably connectable to the first male connector, so that the upholstery layer is selectively removable from the receiving space and replaceable with another one of a different material. Also, the elastic support system is selectively replaceable with another one, and the comfort system is selectively replaceable with another one, too. Thus, a mattress can be made up to meet user desirable resilience and support strength to disperse pressure applied to the mattress by the user lying thereon. In addition, in the present invention, the joining fabric layer is provided on its upper surface with a locating fabric and the inner cover is provided on its undersurface with a locating pattern, which can be selectively connected to any location on the locating fabric, allowing the overlapped area between the comfort system and the elastic support system to be changeable in size. Further, the connecting materials include two transverse connecting stripes and two longitudinal connecting stripes; and the transverse connecting stripes and the longitudinal connecting stripes are spaced from one another, so that a plurality of corner gaps is formed between the inner cover and the joining fabric layer. A user may extend his or her hands into the corner gaps to easily separate the comfort system from the elastic support system.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
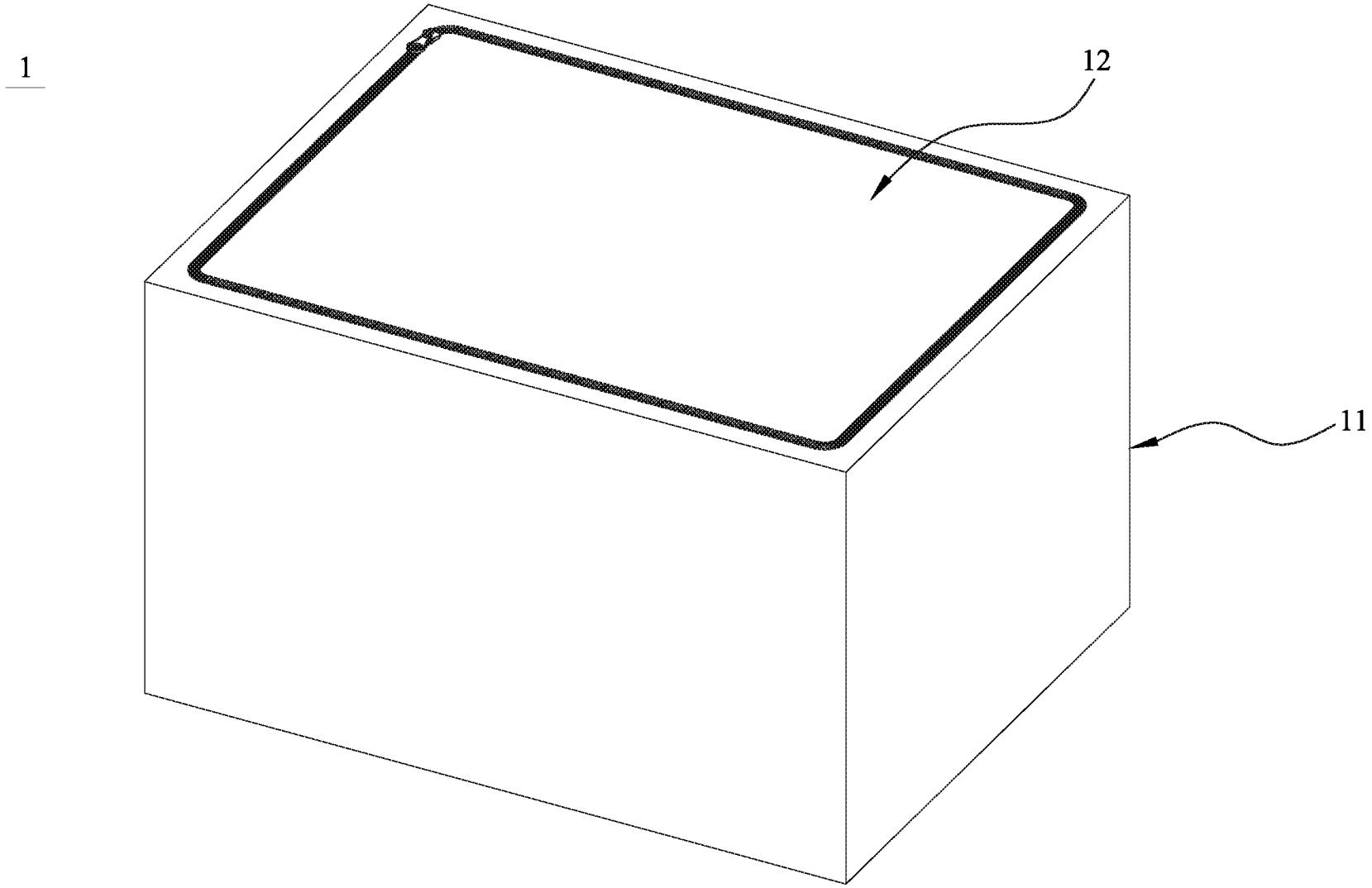
FIG. 1 is a schematic perspective view of a mattress with replaceable internal layers and outer cover according to a first preferred embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 2:
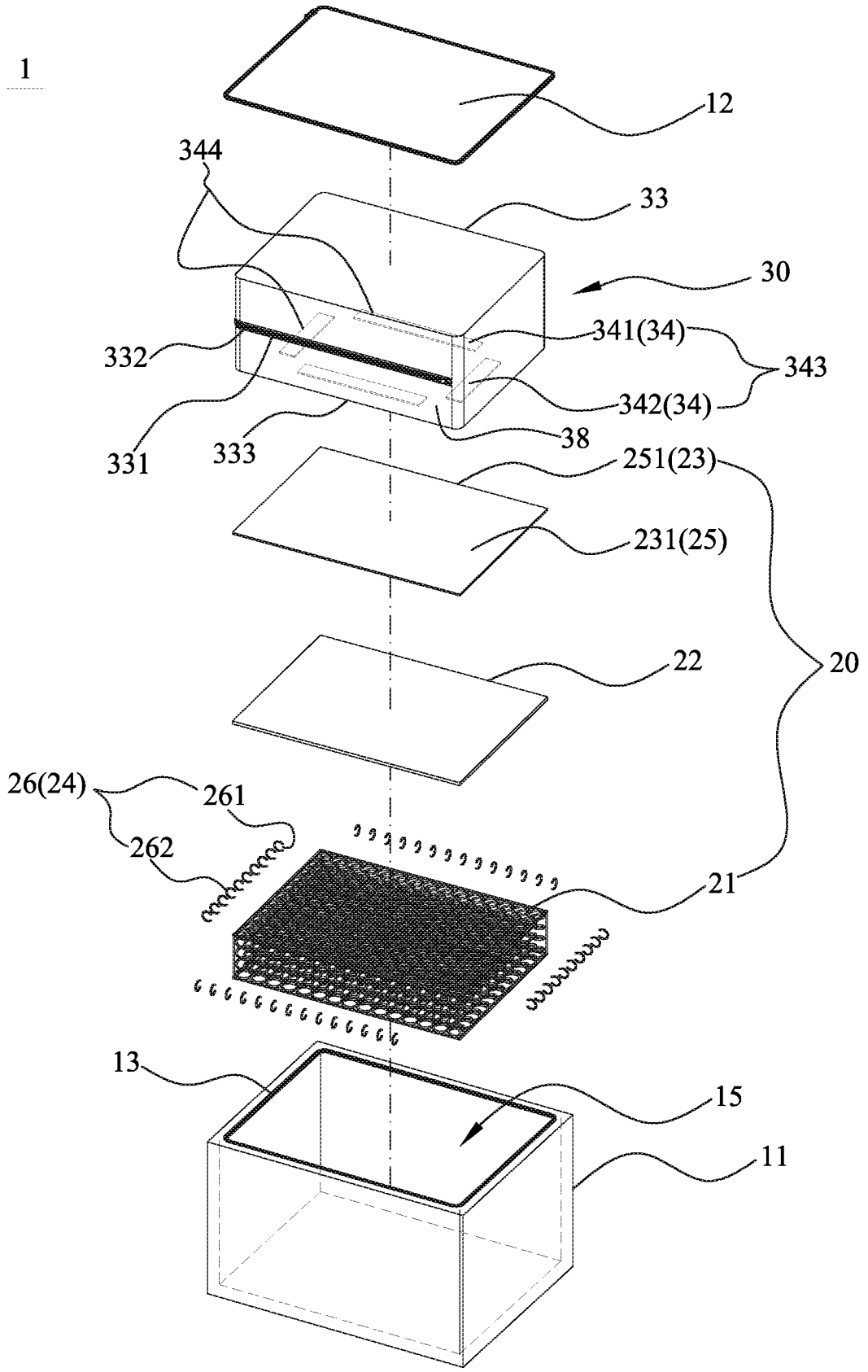
FIG. 2 is an exploded view of FIG. 1.
Figure 3:
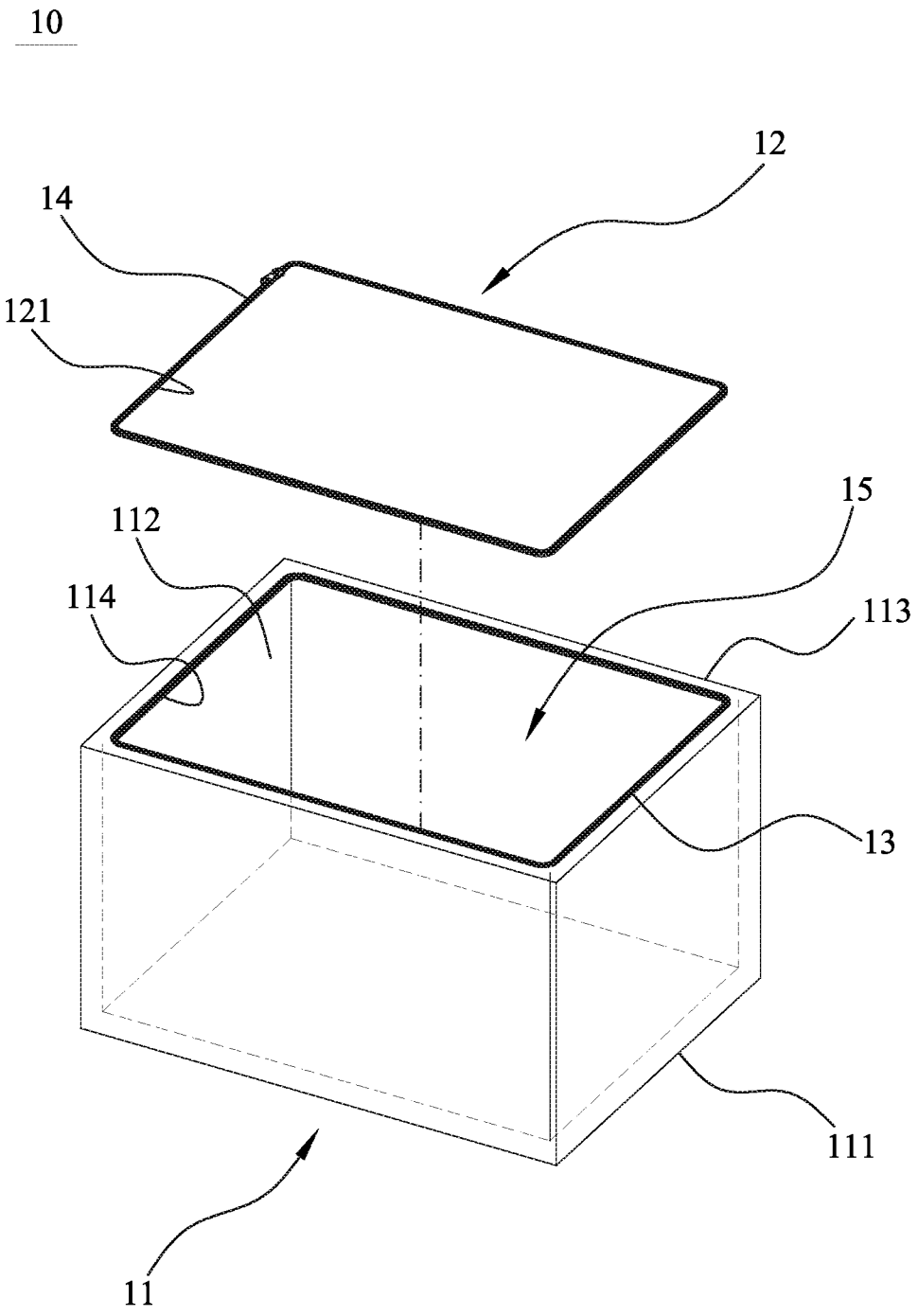
FIG. 3 is an exploded perspective view of an outer cover for the mattress according to the first preferred embodiment of the present invention.

Please refer to FIGS. 1, 2 and 3, in which a mattress 1 with replaceable internal layers and outer cover according to a first preferred embodiment of the present invention is shown. For the purpose of conciseness, the present invention is also briefly referred to as the mattress herein. As shown, the mattress 1 includes an outer cover 10, an elastic support system 20, and a comfort system 30. The outer cover 10 includes a bed frame 11 and an upholstery layer 12. The bed frame 11 is disposed at the lowermost part of the mattress 1 and includes a bottom 111 and a sidewall 112 connected to four sides of the bottom 111. The sidewall 112 has an upper end 113 provided with a first male connector 13, which extends along an inner perimeter 114 of the sidewall 112. The upholstery layer 12 is provided with a first female connector 14, which extends along an outer perimeter 121 of the upholstery layer 12. The first female connector 14 is detachably connected to the first male connector 13, such that the upholstery layer 12 is selectively removable and replaceable with another upholstery layer of a different material. When the first female connector 14 on the upholstery layer 12 is connected to the first male connector 13 on the bed frame 11, a receiving space 15 is enclosed in the bed frame 11 and the upholstery layer 12.

Please refer to FIGS. 2, 4, 5 and 9A. The elastic support system 20 includes a pocket-spring layer 21, a foam isolation pad layer 22, a joining fabric layer 23, and a plurality of fixing elements 24. The pocket-spring layer 21 includes a plurality of pocket springs 211, an upper boarder rod 212, and a lower boarder rod 213. The upper boarder rod 212 is disposed above the pocket springs 211 and the lower boarder rod 213 is disposed below the pocket springs 211. The foam isolation pad layer 22 is disposed above the pocket-spring layer 21 and in contact with the upper boarder rod 212, such that the foam isolation pad layer 22 is located between the pocket-spring layer 21 and the upper boarder rod 212. The joining fabric layer 23 has an upper surface 231 provided with a locating fabric 25 that is connectable to any position. In the illustrated first preferred embodiment, the locating fabric 25 is spread over an entire surface of the joining fabric layer 23 to define a first profile 251.

Figure 4:
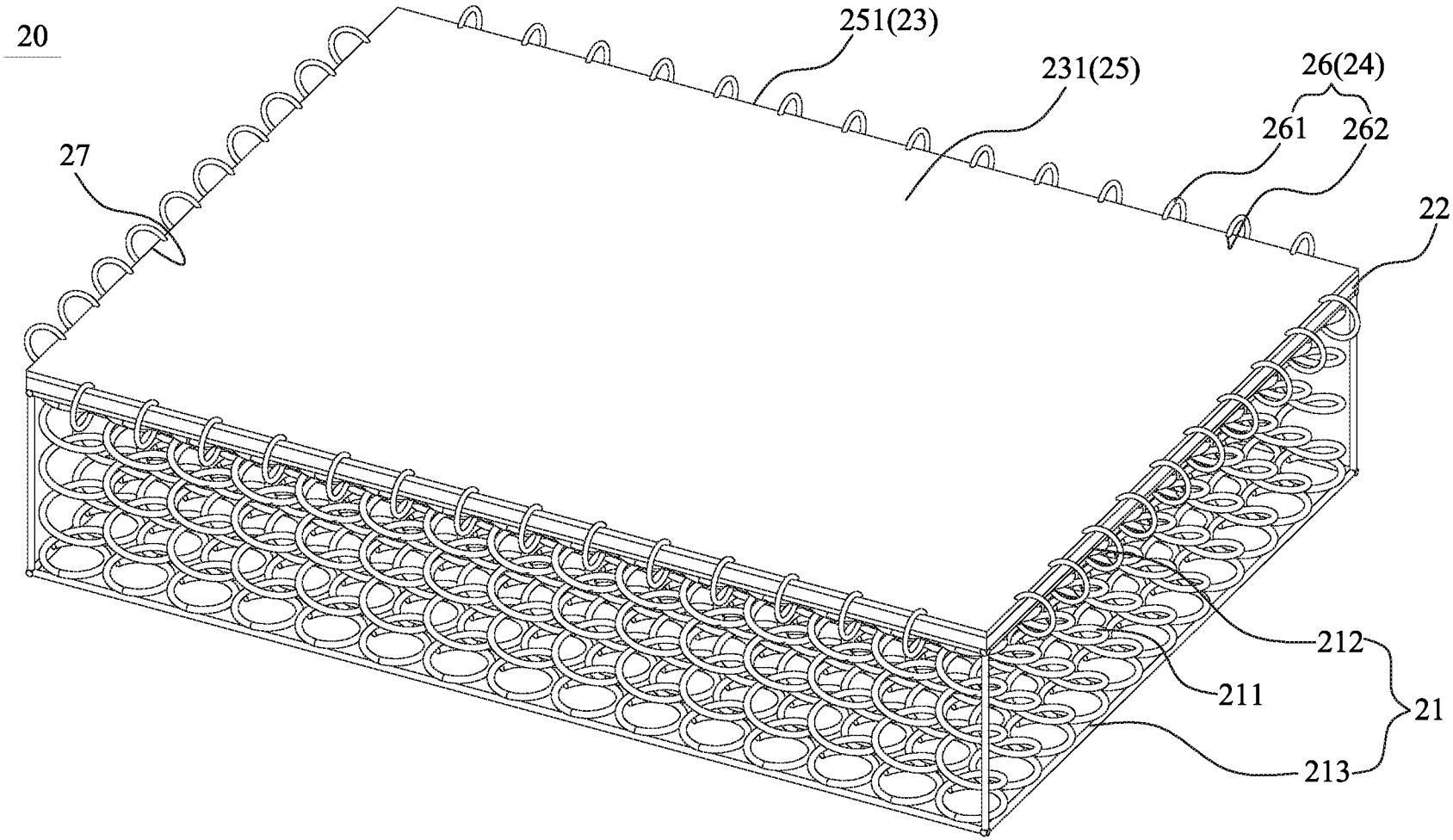
FIG. 4 is an assembled perspective view of an elastic support system for the mattress according to the first preferred embodiment of the present invention.
Figure 5:
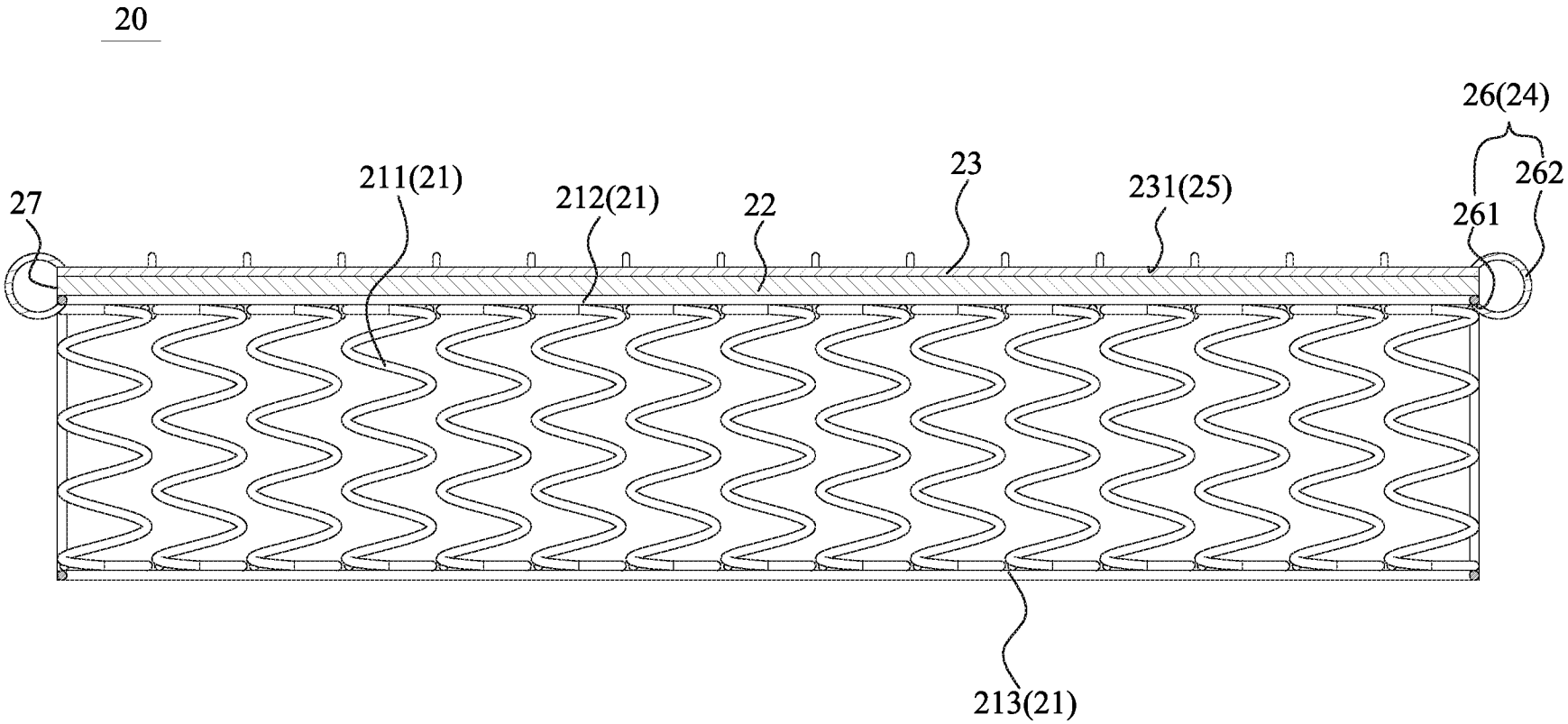
FIG. 5 is a sectional view of the elastic support system shown in FIG. 4.
Figure 6:
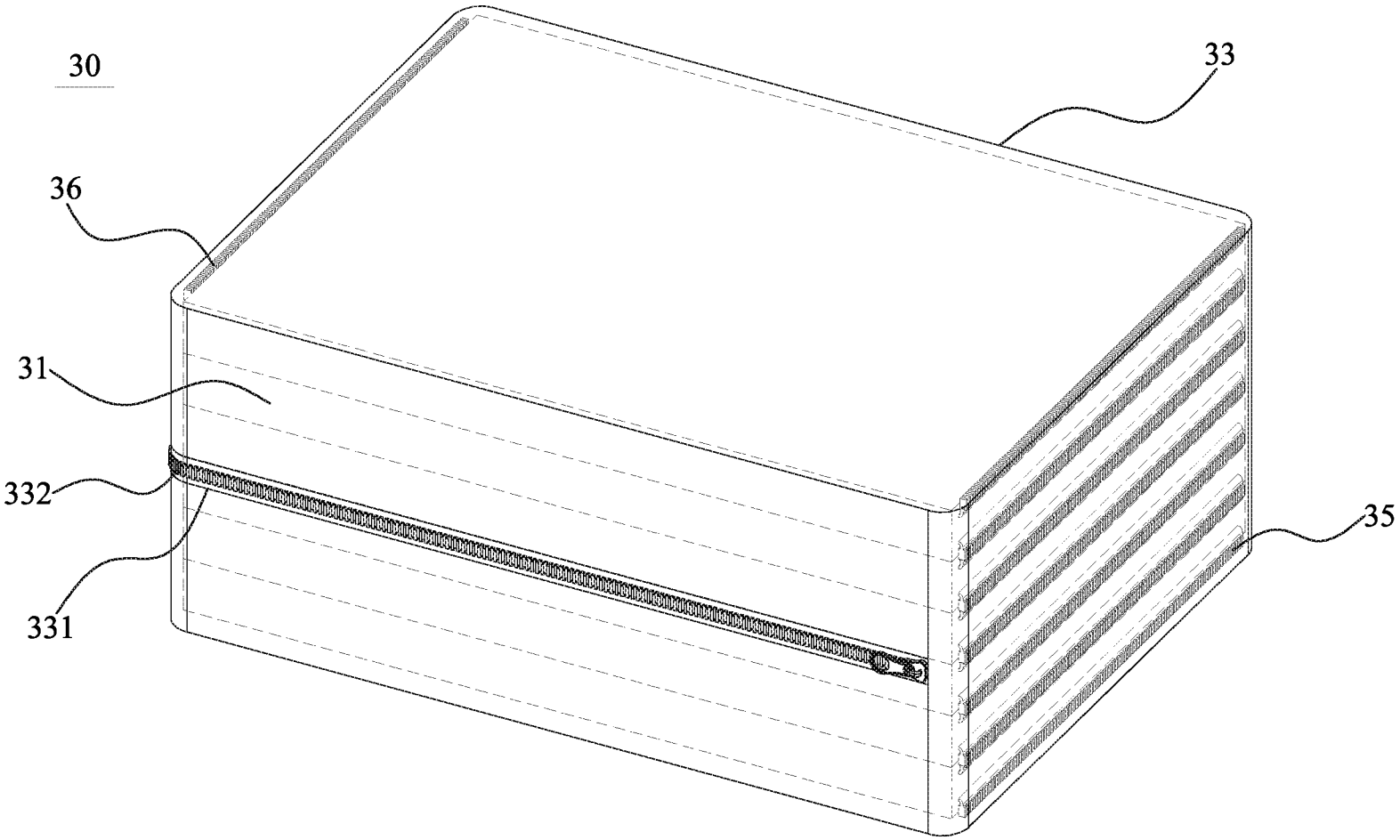
FIG. 6 is an assembled perspective view of a comfort system for the mattress according to the first preferred embodiment of the present invention.
Figure 7:
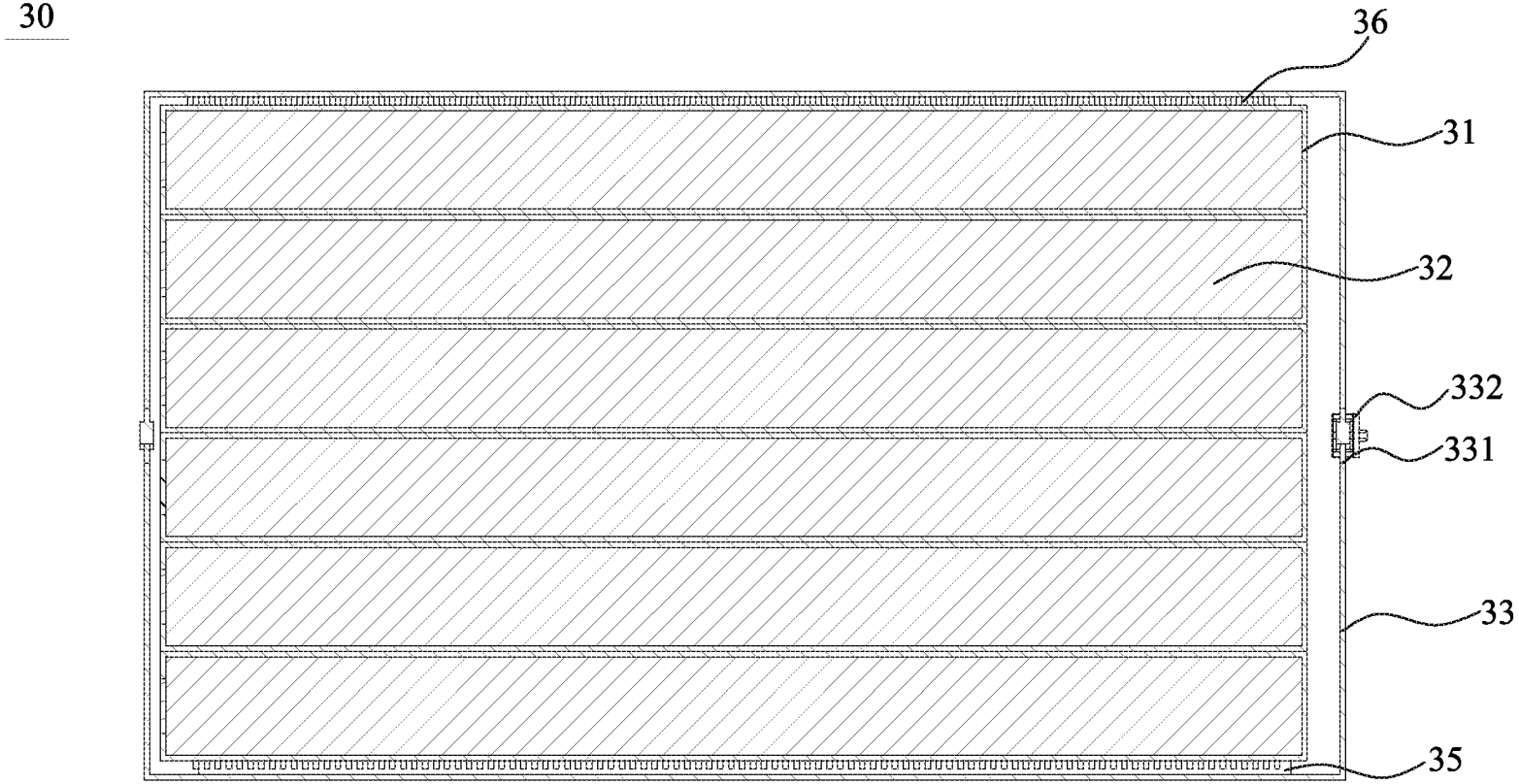
FIG. 7 is a sectional view of the comfort system shown in FIG. 6.
Figure 8:
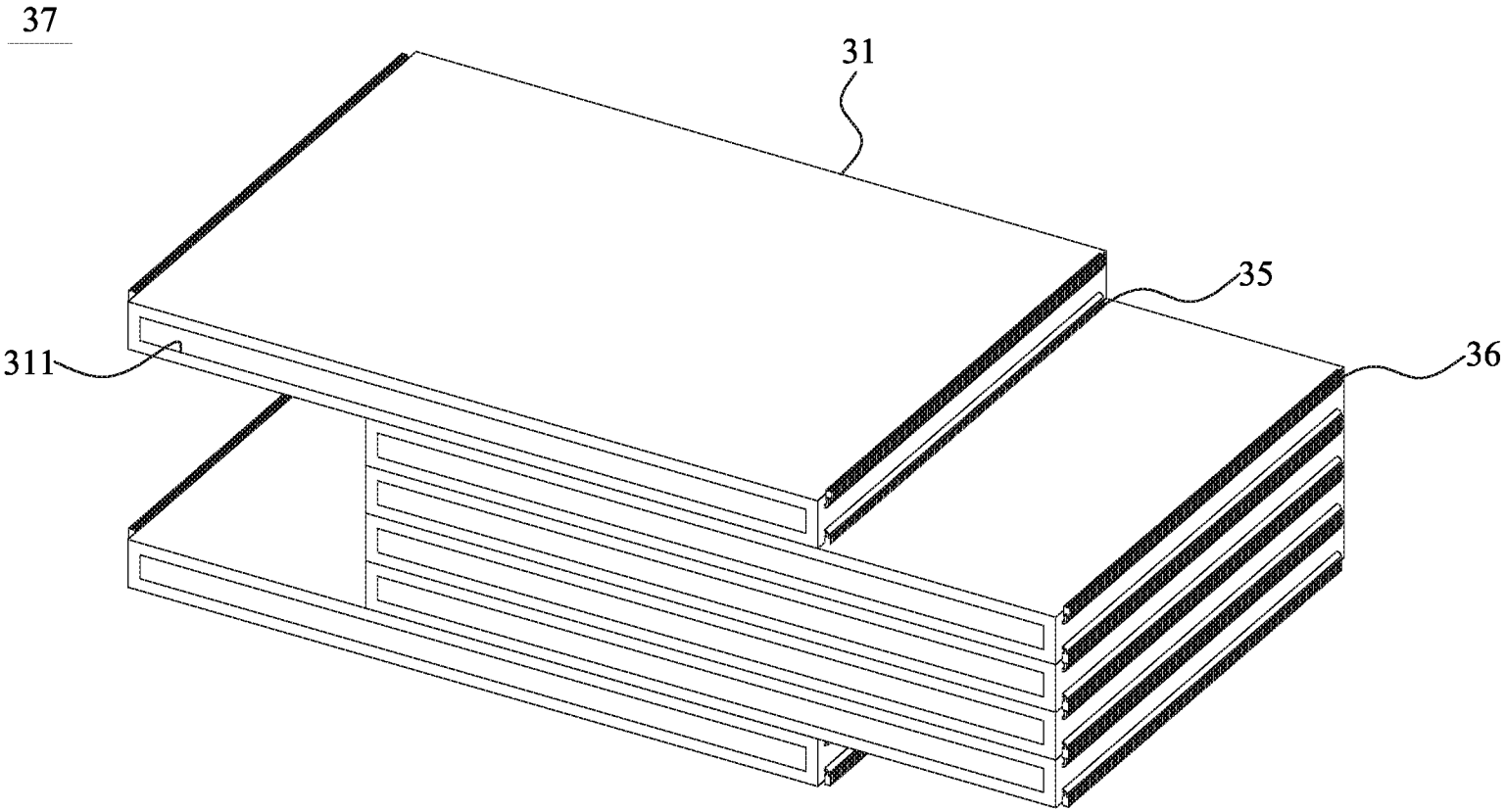
FIG. 8 shows a core for the mattress according to the first preferred embodiment of the present invention.

Please refer to FIGS. 2, 4 and 5. In the illustrated first preferred embodiment, the fixing elements 24 are respectively a C-type retaining ring 26 including a ring body 262 having a gap 261 formed thereon. The joining fabric layer 23 and the foam isolation pad layer 22 can be pushed into the C-type retaining ring 26 via the gap 261, such that two opposite ends of the ring body 262 located at two lateral sides of the gap 261 are pressed against the upper surface 231 of the joining fabric layer 23 and the upper boarder rod 212 of the pocket-spring layer 21, respectively, and the joining fabric layer 23, the foam isolation pad layer 22 and the pocket-spring layer 21 are clamped together by the C-type retaining rings 26. By spacing the fixing elements 24 along a perimeter 27 of the elastic support system 20, the pocket-spring layer 21, the foam isolation pad layer 22 and the joining fabric layer 23 are bound to one another. With this arrangement, any one of the pocket-spring layer 21, the foam isolation pad layer 22 and the joining fabric layer 23 can be selectively removed and replaced with another pocket-spring layer 21, another foam isolation pad layer 22, and another joining fabric layer 23, respectively. Therefore, the elastic support system 20 can be replaced with another elastic support system for fitting in the receiving space 15.

Please refer to FIGS. 2, 6, 7, 8 and 9A. In the illustrated first preferred embodiment, the comfort system 30 includes a plurality of separate dividing covers 31, a plurality of pad layers 32, an inner cover 33, and a plurality of connecting materials 34. Each of the separate dividing covers 31 has a side opening 311, via which the pad layer 32 is fitted into the separate dividing cover 31. With this design, the separate dividing covers 31 can wrap the pad layers 32 in one-to-one correspondence, and the pad layer 32 in each separate dividing cover 31 can be selectively replaced with another desired pad layer 32. Each of the separate dividing covers 31 is provided at each of two opposite ends with a second male connector 35 and a second female connector 36, and the second male and female connectors 35, 36 are located in parallel with one another. Each of the separate dividing covers 31 can be connected to an adjoining one through engagement of the second male connector 35 or the second female connector 36 provided thereon with the second female connector 36 or the second male connector 35 on the adjoining separate dividing cover 31. In this way, the separate dividing covers 31 may be arranged in different sequence or be selectively replaced with another one. The separate dividing covers 31 are vertically arranged side by side to form a core 37 of the comfort system 30. Further, the first male and female connectors 13, 14 and the second male and female connectors 35, 36 are not necessarily restricted to any particular structural configuration. The first male and female connectors 13, 14 and the second male and female connectors 35, 36 may be respectively in the form of a zipper tape, a Velcro tape, a magic tape, a button, a hooking ring, a hook, a screw fastener, or a woven belt.

Please refer to FIGS. 3, 4 and 5. In the first preferred embodiment, the inner cover 33 is provided with an opening 331 and a closure zipper 332. The separate dividing covers 31 along with the pad layers 32 stuffed therein are fitted into the inner cover 33 via the opening 331 before the opening 331 is closed with the closure zipper 332, so that the pad layers 32 are vertically arranged in the inner cover 33 to form the core 37 of the comfort system 30. After the closure zipper 332 closes the opening 331, the pad layers 32 are enclosed in the inner cover 33 without the risk of moving out of the inner cover 33.

Figure 9A:
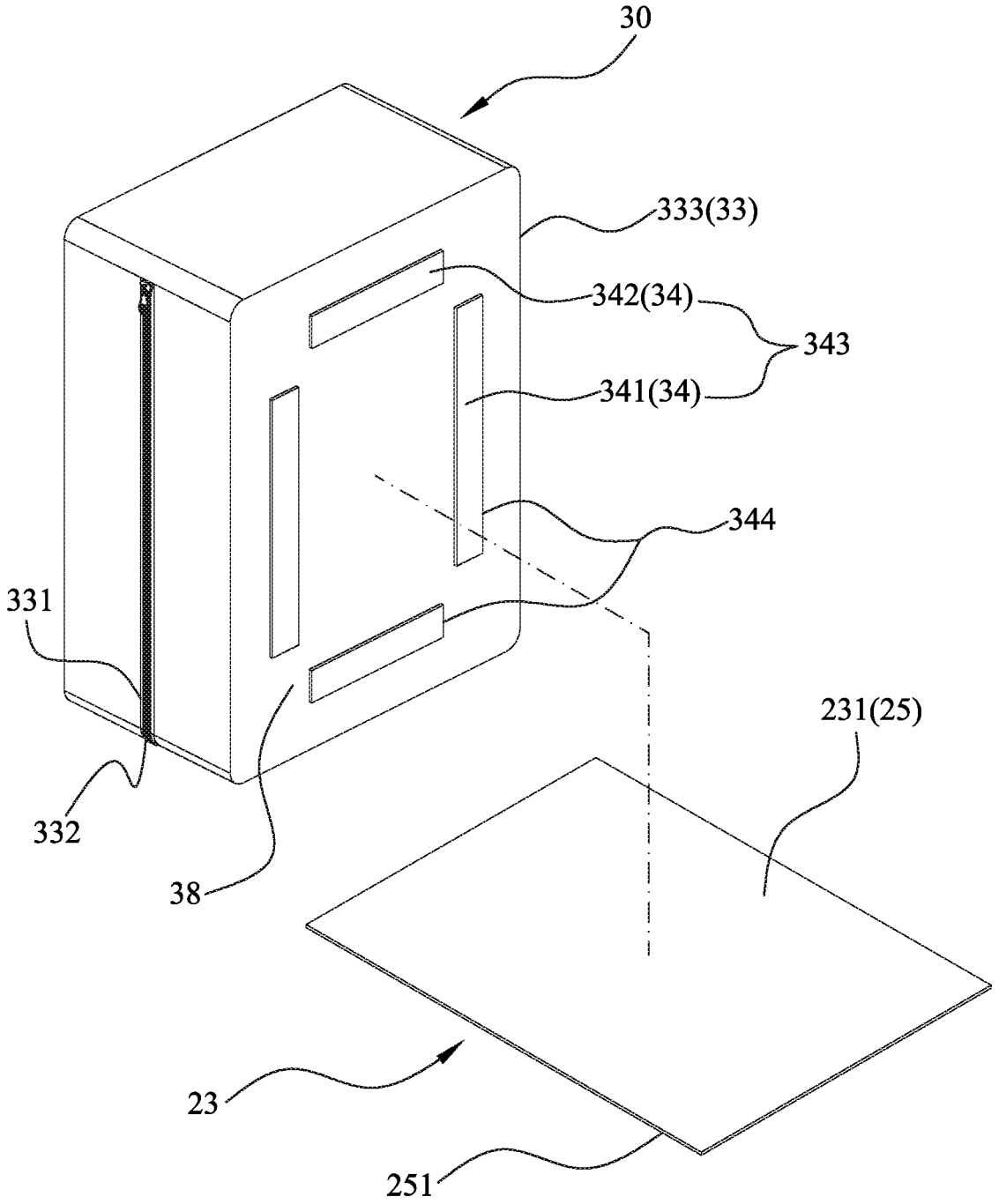
FIGS. 9A to 9C show the way of connecting the comfort system to the elastic support system in the mattress according to the first preferred embodiment of the present invention.
Figure 9B:
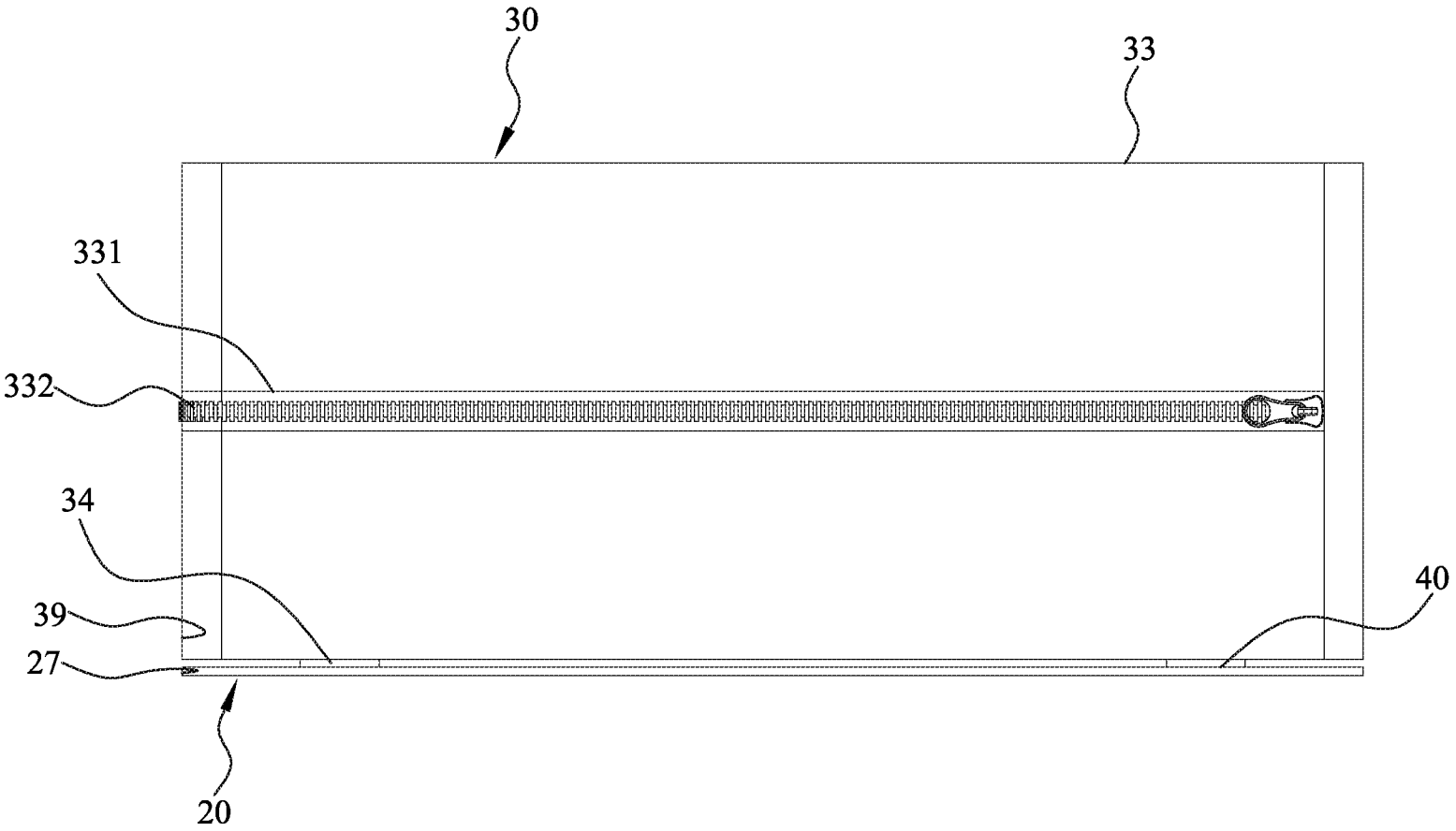

Please refer to FIGS. 2, 9A and 9B. In the illustrated first preferred embodiment, the connecting materials 34 include two transverse connecting stripes 341 and two longitudinal connecting stripes 342. The transverse connecting stripes 341 are not in contact with the longitudinal connecting stripes 342, such that a plurality of corner gaps 38 is formed between the inner cover 33 and the joining fabric layer 23. A user may easily extend his or her hands through the corner gaps 38 to quickly detach the comfort system 30 from the elastic support system 20, such that the comfort system 30 can be selectively removed from the receiving space 15 and replaced with another one, giving the mattress 1 desirable resilience and support strength to disperse pressure applied by a user lying on the mattress 1.

Figure 9C:
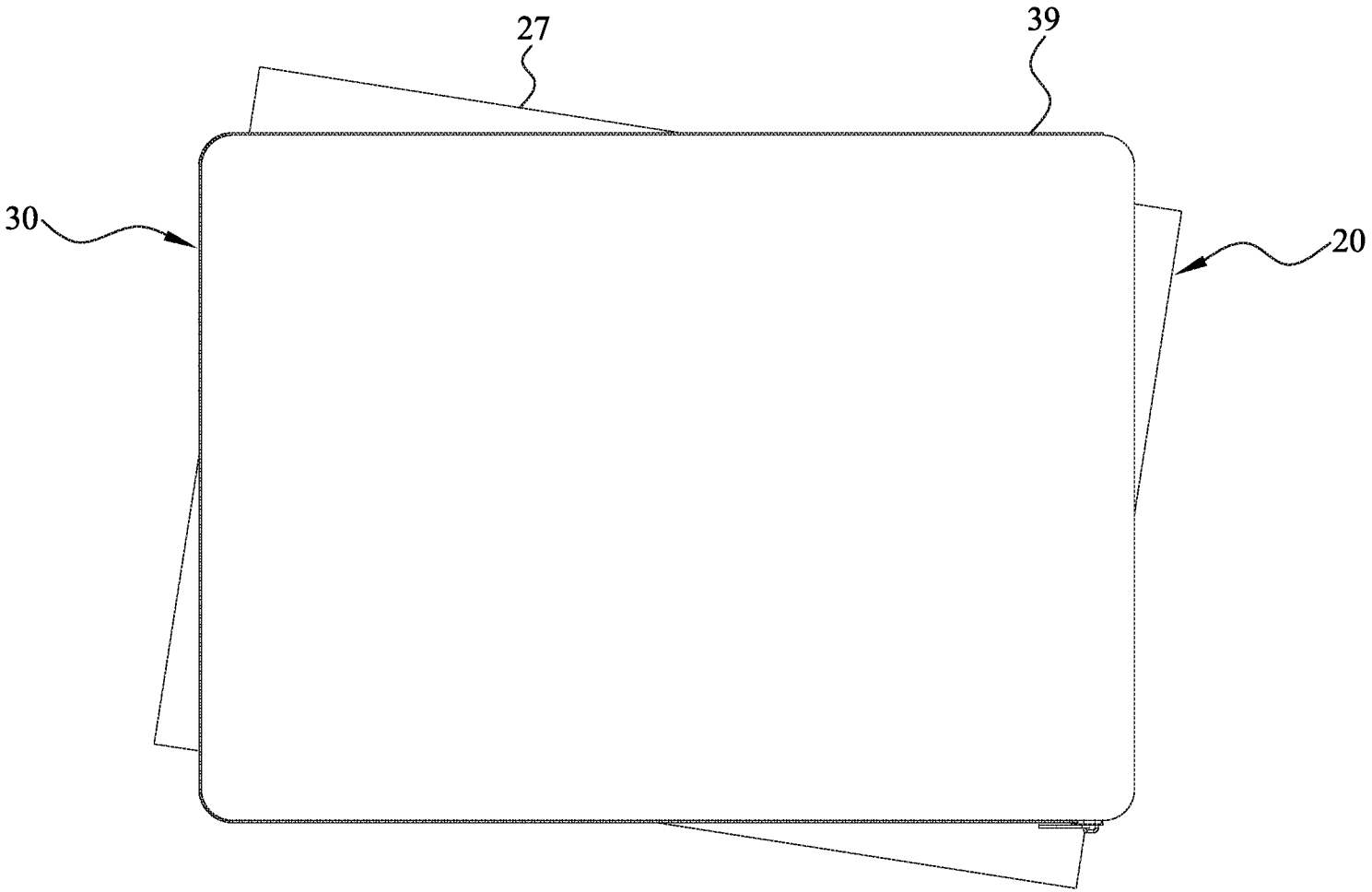

Further, the connecting materials 34 of the comfort system 30 are disposed on an undersurface 333 of the inner cover 33 to form a locating pattern 343. The locating pattern 343 is distributed over a partial surface of the inner cover 33 to define a second profile 344, which covers an area smaller than that of the first profile 251 defined on the locating fabric 25, such that the locating pattern 343 may be selectively connected to any location on the locating fabric 25, so that an overlapped area 40 between the comfort system 30 and the elastic support system 20 is changeable in size. Please refer to FIG. 9B. The comfort system 30 has an outer perimeter 39, at least a part of which is in alignment with the perimeter 27 of the elastic support system 20, so that the comfort system 30 can be completely superposed on the elastic support system 20. Or alternatively, as shown in FIG. 9C, the comfort system 30 may have at least a part of its outer perimeter 39 located at a distance from the perimeter 27 of the elastic support system 20, so that the comfort system 30 is disposed on the elastic support system 20 to overlap the latter.

Figure 10:
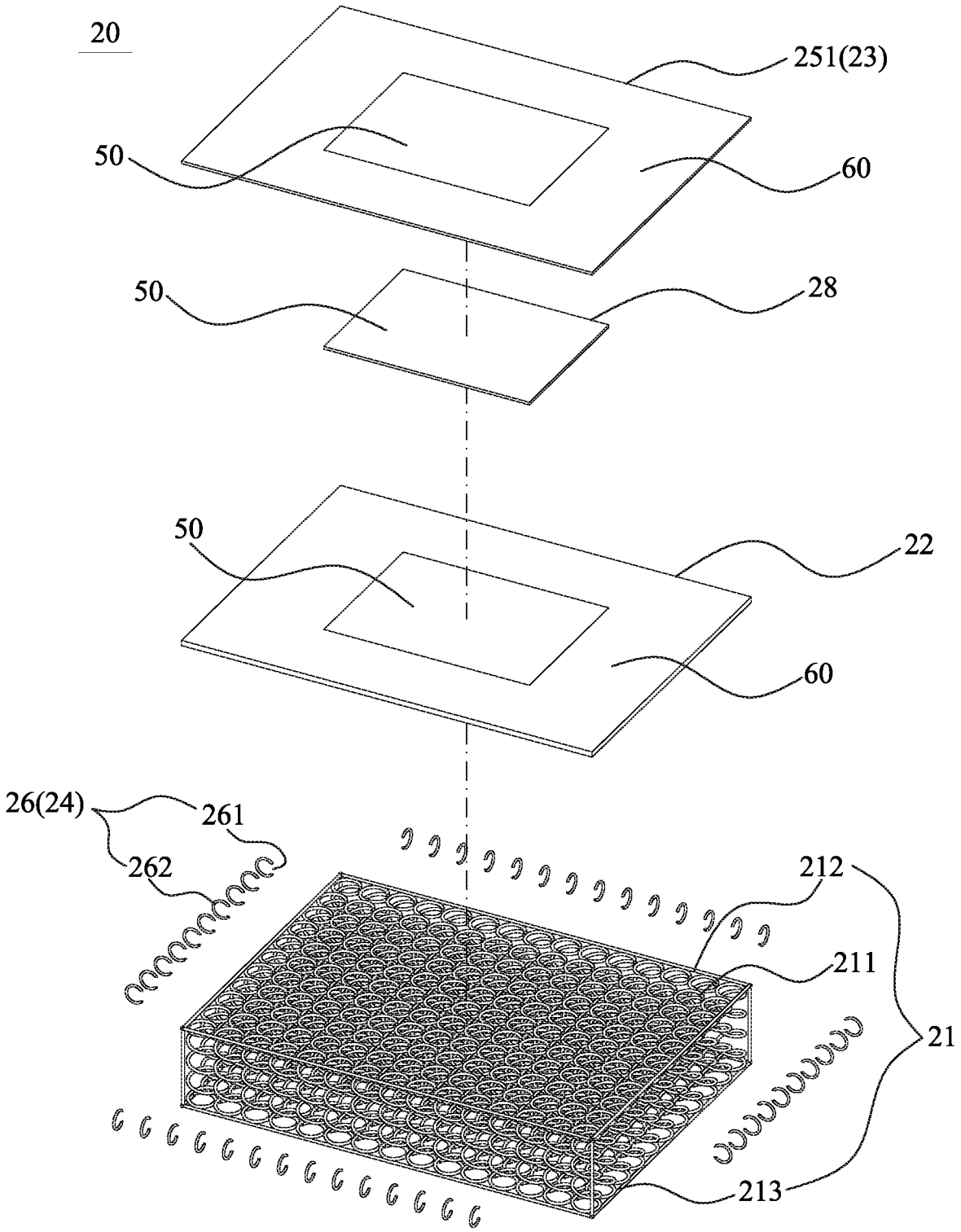
FIG. 10 is an exploded perspective view of an elastic support system for the mattress according to a second preferred embodiment of the present invention.

Please refer to FIG. 10, which is an exploded perspective view of an elastic support system 20 for the mattress according to a second preferred embodiment of the present invention. The first and the second preferred embodiment of the present invention include outer covers 10 and comfort systems 30 of similar structural configuration, which are not repeatedly described herein. However, the elastic support system 20 in the second preferred embodiment further includes a bonding layer 28 in addition to the pocket-spring layer 21, the form isolation layer 22, the joining fabric layer 23, and the fixing elements 24. The bonding layer 28 is disposed between the foam isolation pad layer 22 and the joining fabric layer 23 to form an inner connecting zone 50; and the fixing elements 24 are arranged on around the joining fabric layer 23 and the foam isolation pad layer 22 to form a perimeter connecting zone 60, such that the fixing elements 24 are located along outer sides of the inner connecting zone 50. In this way, the pocket-spring layer 21, the foam isolation pad layer 22, and the joining fabric layer 23 are bonded together via the bonding layer 28 and clamped to one another by the fixing elements 24.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A mattress with replaceable internal layers and outer cover, comprising:

an outer cover including a bed frame and an upholstery layer; the bed frame being provided with a first male connector and the upholstery layer being provided with a first female connector for detachably connecting to the first male connector, such that the upholstery layer is selectively removable and replaceable with another upholstery layer; the bed frame including a bottom and a sidewall connected to four sides of the bottom, so that a receiving space is defined between the bed frame and the upholstery layer;

an elastic support system removably fitted in the receiving space and including a pocket-spring layer, a foam isolation pad layer, a joining fabric layer, and a plurality of fixing elements; the foam isolation pad layer being disposed between the pocket-spring layer and the joining fabric layer; an upper surface of the joining fabric layer being provided with a locating fabric; and the fixing elements being spaced on around a perimeter of the elastic support system to bind the pocket-spring layer, the foam isolation pad layer and the joining fabric layer to one another; and a comfort system being removably fitted in the receiving space and including a plurality of pad layers, an inner cover, and a plurality of connecting materials; the pad layers being wrapped in the inner cover, the connecting materials including two transverse connecting stripes and two longitudinal connecting stripes, the transverse connecting stripes and the longitudinal connecting stripes are disposed on an undersurface of the inner cover to define a locating pattern having corner gaps formed between the inner cover and the locating fabric layer; and the locating pattern being selectively connectable to any location on the locating fabric, so that an overlapped area between the comfort system and the elastic support system is changeable in size; and wherein the comfort system includes a plurality of separate dividing covers for wrapping the pad layers in one-to-one correspondence; each of the separate dividing covers being provided at each of two opposite ends with a second male connector and a second female connector, and any separate dividing cover being connectable to an adjoining one through engagement of the second male connector provided thereon with the second female connector on the adjoining separate dividing cover, such that the separate dividing covers are vertically arranged side by side to form a core of the comfort system; and wherein the elastic support system is selectively removable and replaceable with another elastic support system, and the comfort system is also selectively removable and replaceable with another comfort system, so as to provide a mattress that has user desirable resilience and support strength to disperse pressure applied by the user on the mattress.

2. The mattress with replaceable internal layers and outer cover as claimed in claim 1, wherein the elastic support system further includes a bonding layer disposed between the foam isolation pad layer and the joining fabric layer to form an inner connecting zone; and the fixing elements being located around the joining fabric layer and the foam isolation pad layer to form a perimeter connecting zone.

3. The mattress with replaceable internal layers and outer cover as claimed in claim 1, wherein the inner cover has an opening provided with a closure zipper that openably closes the opening; and the pad layers stuffed in the separate dividing covers being fitted into the inner cover via the opening and vertically arranged side by side to form the core of the comfort system before the closure zipper is closed.

4. The mattress with replaceable internal layers and outer cover as claimed in claim 1, wherein the fixing elements are respectively a C-type retaining ring including a ring body with a gap formed thereon; the joining fabric layer and the foam isolation pad layer being pushed into the C-type retaining ring via the gap, such that two opposite ends of the ring body are pressed against the joining fabric layer and an upper boarder rod of the pocket-spring layer to clamp the joining fabric layer, the foam isolation pad layer and the pocket-spring layer together.

5. The mattress with replaceable internal layers and outer cover as claimed in claim 1, wherein the locating fabric is spread over an entire surface of the joining fabric layer to define a first profile, and the locating pattern is distributed over a partial surface of the inner cover to define a second profile that has an area smaller than that of the first profile.

* * * * *